US010822896B2

(12) United States Patent
Duphorne et al.

(10) Patent No.: US 10,822,896 B2
(45) Date of Patent: Nov. 3, 2020

(54) BYPASS VALVE

(71) Applicant: Baker Hughes, a GE company, LLC, Houston, TX (US)

(72) Inventors: Darin H. Duphorne, Jersey Village, TX (US); Gregory L. Hern, Porter, TX (US); William A. Hered, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 233 days.

(21) Appl. No.: 15/805,640

(22) Filed: Nov. 7, 2017

(65) Prior Publication Data

US 2019/0136653 A1 May 9, 2019

(51) Int. Cl.

| | |
|---|---|
| ***E21B 21/10*** | (2006.01) |
| ***E21B 34/10*** | (2006.01) |
| ***E21B 7/20*** | (2006.01) |
| ***E21B 45/00*** | (2006.01) |
| *E21B 34/14* | (2006.01) |

(52) U.S. Cl.

CPC ..... *E21B 21/103* (2013.01); *E21B 7/203* (2013.01); *E21B 34/10* (2013.01); *E21B 45/00* (2013.01); *E21B 34/14* (2013.01); *E21B 2200/06* (2020.05)

(58) Field of Classification Search

CPC combination set(s) only.

See application file for complete search history.

(56) References Cited

U.S. PATENT DOCUMENTS

| | | | | |
|---|---|---|---|---|
| 3,597,930 | A * | 8/1971 | Rochelle | E02B 17/00 405/211 |
| 4,310,058 | A * | 1/1982 | Bourgoyne, Jr. | E21B 21/00 175/207 |
| 4,573,496 | A * | 3/1986 | Richard | B62D 5/083 137/625.21 |
| 4,657,082 | A * | 4/1987 | Ringgenberg | E21B 23/006 166/336 |
| 6,263,969 | B1 | 7/2001 | Stoesz et al. | |
| 6,322,102 | B1 * | 11/2001 | Rau | B60R 21/26 280/736 |
| 9,328,576 | B2 | 5/2016 | Cramer et al. | |
| 2016/0298430 | A1 * | 10/2016 | Beranger | E21B 43/08 |
| 2019/0048684 | A1 * | 2/2019 | Kao | E21B 34/14 |

* cited by examiner

*Primary Examiner* — Taras P Bemko
*Assistant Examiner* — Ronald R Runyan
(74) *Attorney, Agent, or Firm* — Shawn Hunter

(57) ABSTRACT

A method and apparatus for controlling fluid flow through a drill string includes a housing having an axis, a radial wall with a bore extending axially therethrough, and an aperture formed in the radial wall. The aperture is in fluid communication with the bore. A piston is located inside the housing and has an orifice configured to permit axial fluid flow through the housing. The spring axially biases the piston to a closed position.

25 Claims, 8 Drawing Sheets

BYPASS VALVE

FIELD OF THE INVENTION

The field of the invention is flow control devices for straight through flow controlled by directing excess flow out a lateral port and more particularly where the flow orifice and recirculation flow path are above the lateral exit port when there is no lateral flow out the lateral exit port.

BACKGROUND OF THE INVENTION

Conventional oil and gas drilling typically includes pumping a quantity of fluid through a pipe or drill string to a drill bit for cutting the hole in the rock. The fluid is then circulated back up though the wellbore in the annular or outer section of the hole. Drilling fluid is beneficial to the drilling process since it clears away pieces of rock that have been cut from the bottom of the wellbore. Without this cleaning action the cut pieces of rock would accumulate near the drill bit and interfere with further drilling. Apart from a drilling application there are also milling applications such as milling out frack plugs after the fracturing operation is completed.

In general, the higher level of fluid flow that a drilling operation can achieve, the better that cut pieces of rock or "cuttings" are cleared from the bottom of the wellbore. However, there are several factors that limit the fluid flow level. One of these factors is the amount of pressure that it takes to pump a large amount of fluid. As the drill string becomes longer or narrower, the resistance to pumping a given amount of fluid increases, which increases the need for higher pressure. With any fluid pump set up there is a limit to the amount of pressure that can be overcome in order to make the fluid flow. Accordingly, the size or type of pump can limit the available flow rate.

Another limiting factor is the capability of the downhole mud motor. Mud motors are used to make the rock cutting drill bit rotate faster than the drill pipe that it is connected to. For example, a drilling operator may desire to drill while holding the drill string stationary, or may want to rotate the drill bit faster to achieve a higher rate of rock penetration. The mud motor works in a manner similar to a turbine in that the mud that flows through the motor turns a rotor that is connected to the drill bit. Energy from the pressure of the fluid flow is converted into rotational work by the drill bit. Mud motors are usually designed such that there is a maximum amount of flow that the motors are designed to handle. Forcing excess fluid through a mud motor can damage the motor and inhibit the drilling process.

The desire to flow higher volumes of drilling fluid through the well and the need to limit the volume flow rate due to the constraints of the motor can be conflicting. It would be desirable to flow as much fluid as is desired while ensuring that the motor did not experience a rate of flow higher than its design criteria.

A conventional solution to this problem is to form annular ports in the drill string above the mud motor. By choosing the size of the ports, the amount of flow that exits through the ports and the amount of flow that continues on through the drill string into the mud motor can be approximated.

A problem with this technique is that the amount of fluid that exits through the ports varies depending on the back pressure from the mud motor. The back pressure from the mud motor is a factor of the torque that it delivers. Thus, the more torque that is needed or generated by the motor, the higher the back pressure from the motor, which diverts more fluid through the ports in the sides of the drill string. More diverted flow means less fluid is transferred down through the motor. Less fluid to the motor reduces its torque and power, which can induce a situation where the motor stalls and needs more torque to overcome its bound condition. Conversely, an off-bottom situation where there is relatively low amounts of back pressure generated by the motor because there is no drilling torque resistance can result in a higher amount of fluid passing through the motor and a lower amount of fluid exiting the drill string. This too is problematic since a low torque situation causes the motor to spin faster at a given flow rate. Increased amounts of flow will only exacerbate this situation.

Some motor manufacturers attempt to solve this problem by drilling a hole through the rotor of the mud motor so that some fluid may pass through the tool without generating torque or causing damage to the motor. Unfortunately, since the drilled hole is static and does not change its shape to account for differing flow or pressure conditions, it is subject to the same limitations as the previously described method. Thus, improvements in controlling drill string fluid flow continue to be of interest.

In one design previously introduced all the flow goes though the orifice that is in a movable sleeve that is spring biased. Increasing flow rate has to go through the orifice before reaching a lateral port out of the housing that is opening with translation of a piston that supports the orifice. The design is shown in U.S. Pat. No. 6,263,969 and its shortcoming is that all the flow including the motor bypass flow has to pass through the orifice. This design for that reason has limited capacity and requires additional pumping horsepower to push the inline and circulated flow through the orifice.

Another design is shown in U.S. Pat. No. 9,328,576. In this design the orifice is mounted in a movable piston such that increase in flow displaces the piston and the orifice in the piston below the housing circulation port so that some bypass flow can exit a lateral housing port. This design promotes end erosion of the piston in the less than wide open bypass position, as illustrated in FIG. 3.

What is needed and is provided in the below described preferred embodiment is a design that has a parallel path through the top of the piston for flow into the mud motor and for bypassing flow. The bypass channel can be made broad, such as a crescent shape, and multiple exit nozzles can be directed into an annular shaped plenum that leads to multiple circumferentially spaced outlets. A sacrificial protective ring can be placed to define the plenum and protect a piston seal assembly from erosion. The design is enabled with the use of additive manufacturing to make the needed shapes in the most cost effective manner with known technology. These and other aspects of the design will be more readily understood from a review of the description of the preferred embodiment and the associated drawings while recognizing that the full scope of the invention is to be determined from the appended claims.

SUMMARY OF THE INVENTION

Embodiments of a system, method and apparatus for controlling fluid flow through a drill string are disclosed. For example, an apparatus may include a housing having an axis, a radial wall with a bore extending axially therethrough, and an aperture formed in the radial wall. The aperture is in fluid communication with the bore. A piston may be located inside the housing and have an orifice configured to permit axial fluid flow through the housing. A spring may be located in the housing and be configured to axially bias the piston to a closed position.

In some embodiments, the piston is movable from the closed position wherein the piston is configured to close the aperture in the housing to substantially block radial fluid flow therethrough when axial fluid flow through the orifice is insufficient to overcome a spring force of the spring, and an open position wherein the piston is configured to permit radial fluid flow through the aperture when axial fluid flow through the orifice is sufficient to overcome the spring force of the spring and axially move the piston.

In other embodiments, a method of controlling fluid flow through a drill string may include operating the drill string to drill a hole in an earthen formation; pumping fluid through the drill string to a mud motor such that substantially all of the fluid flows axially to the mud motor and substantially none of the fluid is radially diverted out of the drill string; and then increasing a flow rate of the fluid such that some of the fluid is radially diverted out of the drill string before reaching the mud motor, and a remainder of the fluid is flows axially to the mud motor.

In still other embodiments, a method of controlling fluid flow through a drill string may include operating a drill string to drill a hole in an earthen formation; pumping fluid through the drill string; closing a piston in the drill string to direct substantially all of the fluid to a mud motor; and then changing a parameter of the drill string such that the piston moves to an open position allowing at least a portion of the fluid to be diverted away from the mud motor.

DETAILED DESCRIPTION OF THE PREFERRED EMBODIMENT

Figure 1:
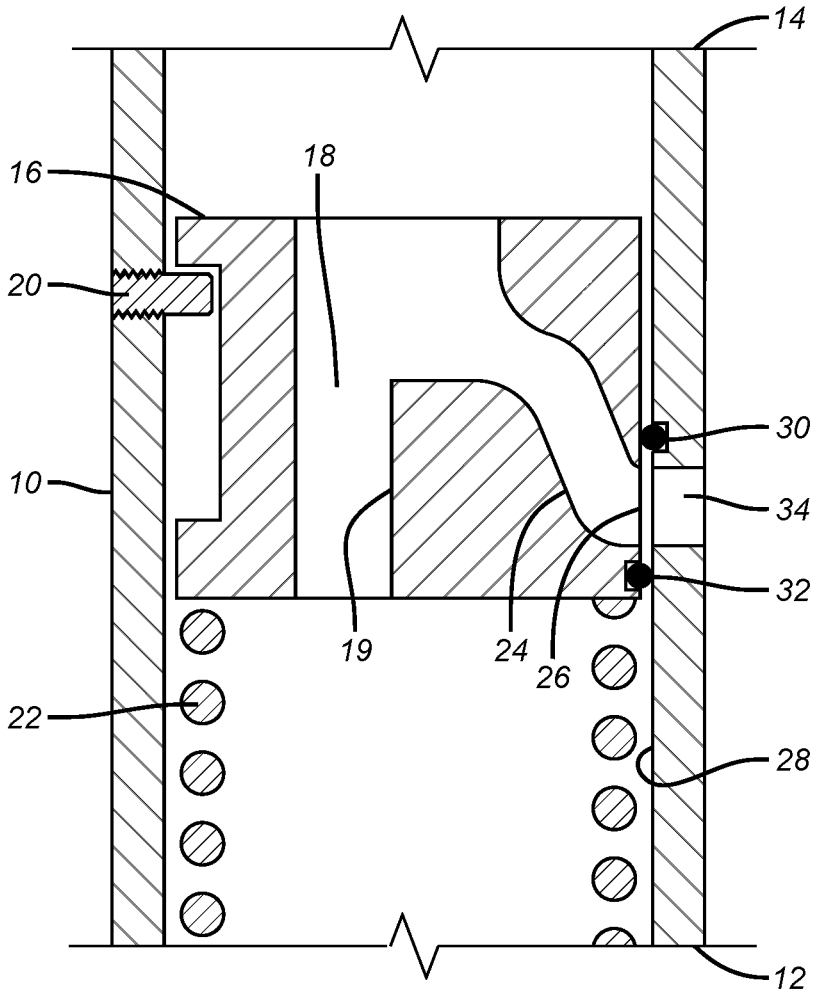
FIG. 1 is a schematic section view in the full bypass open position.
Figure 1A:
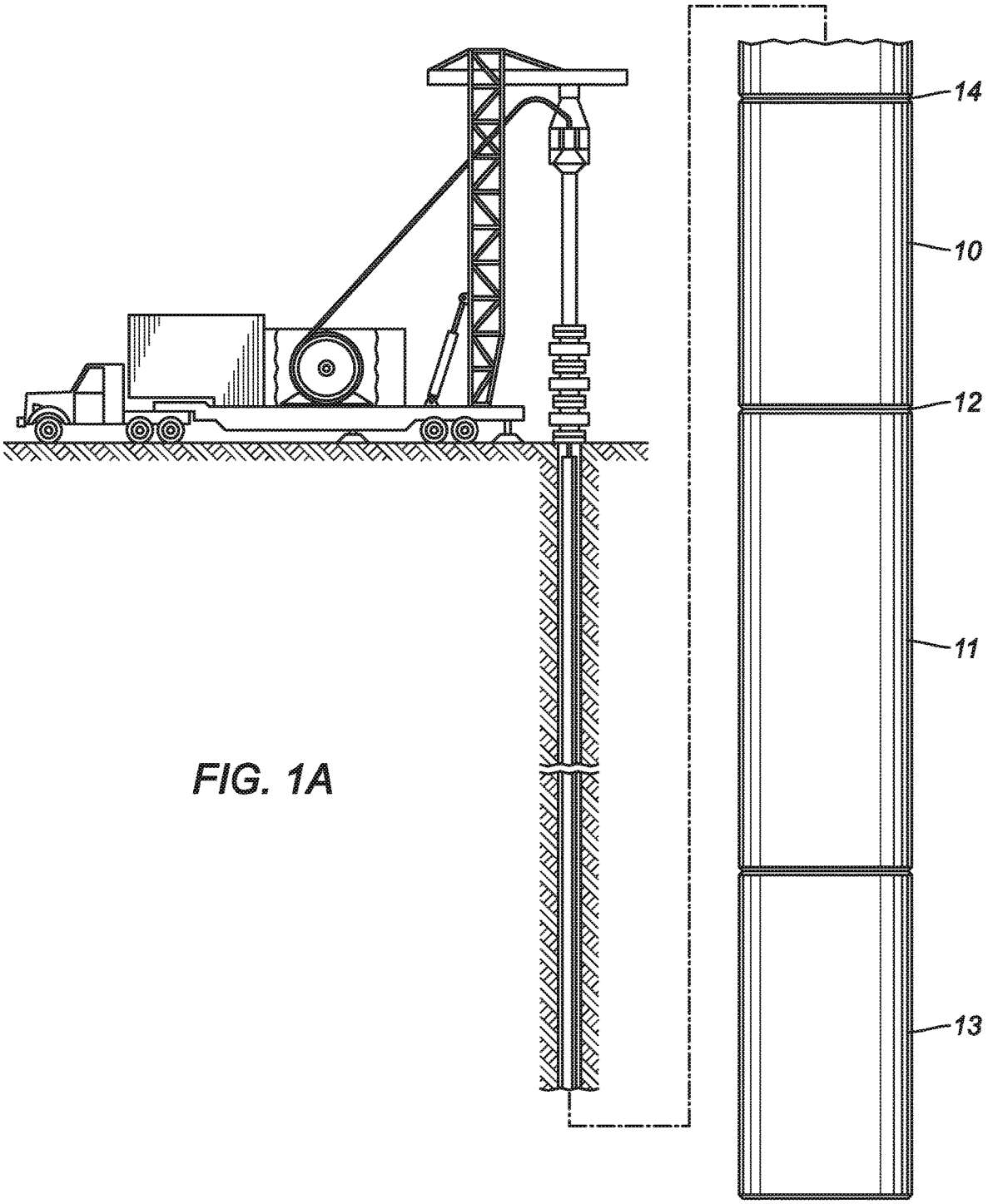
FIG. 1A is a schematic view of portions of the tubular string which include a mud motor and milling tool.

Referring to FIG. 1, a housing 10 is part of a tubular string that is not shown. At the lower end 12 there is a mud motor 11 that operates a tool 13 such as a drill bit, for example, as depicted in FIG. 1A. Above the upper end 14 a string extends to a pump that is not shown to deliver pressurized fluid to the mud motor which is typically a progressing cavity pump also referred to as a mud motor, such as a Moineau style pump. The mud motor 11 needs a steady predetermined flow rate that is maintained through the use of a translating piston 16 that has an orifice 18 and a schematically illustrated combination travel stop and rotational lock 20. A biasing string 22 offers resistance to axial displacement of the piston 16 created by the force to get the predetermined flow rate through orifice 18. Below a predetermined flow rate determined by the size of the orifice 18 and the strength of the spring 22 the piston 16 is located higher than shown in FIG. 1 so that the lateral passage 24 leading to the outlet 26 is closed because it is up against the inside wall of the piston 16 with outlet 26 between spaced seals 30 and 32. Alignment between piston opening 26 and annular port 34 is important to reduce erosion and is achieved when end 35 of extension tube 36 contacts travel stop 37 in housing 10. Flow through orifice 18 travels through internal passage 19 to operate the mud motor 11.

Lateral passage 19 is shown as being crescent shaped. The reason it is preferably crescent shaped is to provide maximum flow area around the internal passage 19. There is a gradual transition from the crescent shape to outlet to minimize erosion. This could also be accomplished by making both passage 19 and 24 crescent shaped, or making passage 19 crescent shaped and passage 24 circular. Another possibility would be for one of both of the passages 19 and 24 to be oval instead of circular.

Life of seals 30 and 32 can be reduced if piston 16 rapidly oscillates in housing 10 because of inconsistent flow rates through the piston. Seal damage can be reduced by controlling how quickly fluid flows in and out of chamber 41 between extension tube 36 and housing 10. By creating a tight radial clearance 39 between extension tube 36 and housing 10 high frequency movement of piston 16 is damped because fluid entering and leaving chamber 41 is restricted by the tight clearance. Passage 24 can be totally independent of passage 18 to the top of piston 16 or intersect passage 18 near the top end of the piston 16 so that incremental flow as piston 16 moves goes through passage 24 as ports 26 and 34 come into alignment. At flow rates above a predetermined level, typically over 4 barrels a minute (for a 2⅞" motor with higher flow rates contemplated for larger motors), displacement of piston 16 begins until travel stop and rotational lock 20 halts axial movement with the outlet 26 aligned with wall opening 34. Although a single passage 24 leading to an opening 26 that ultimately aligns with opening 34 is illustrated, more than one path out of the housing 10 is contemplated as will be later described. The orifice 18 may be a removable disc or a carbide nozzle with a passage through it so that it can be replaced if it wears or it may be integral with passage 19 through the piston 16 that can be lined with a removable sleeve or unlined. In any event, the orifice remains higher than the wall opening 34 even in the full bypass flow out of port 34 into the surrounding annular space. While the recirculation flow out opening or openings 34 is variable the flow to the mud motor that is not shown remains constant. The flow straight through to the mud motor and laterally out the housing 10 both go through the piston 16. Preferably, the total flow rate should be increased so that if there is to be bypass flow out port or ports 34 the axial travel of the piston 16 should be at the stop represented by 20 so that openings 26 line up with openings 34. Variations of the FIG. 1 schematic design will be described below.

Figure 2:
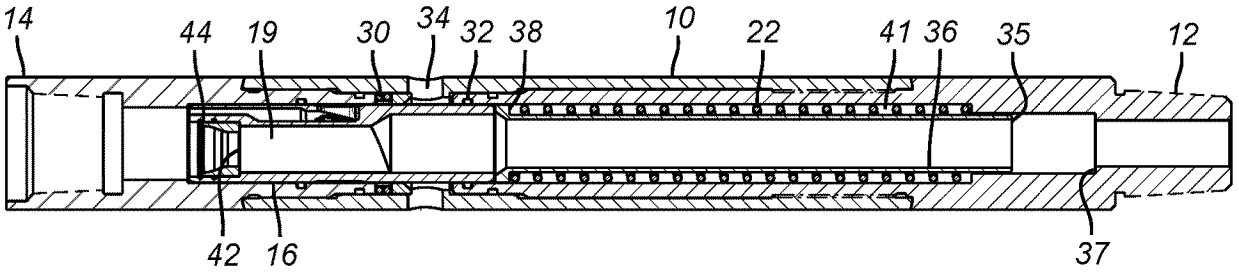
FIG. 2 is a section view in the flow through position with no bypass flow.
Figure 3:
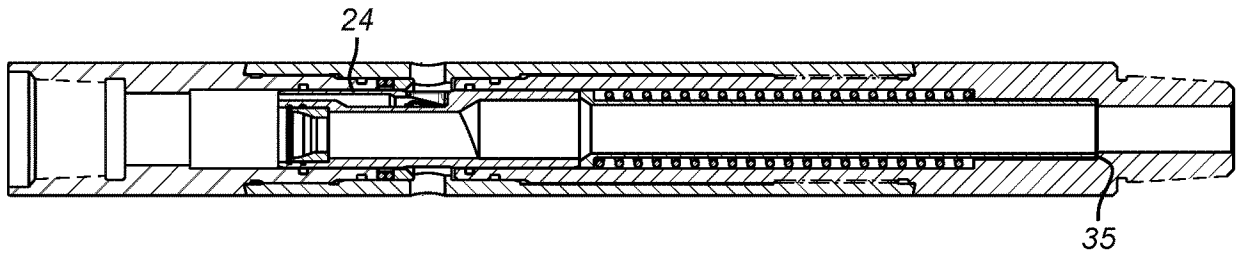
FIG. 3 is the view of FIG. 2 with full bypass flow open.
Figure 4:
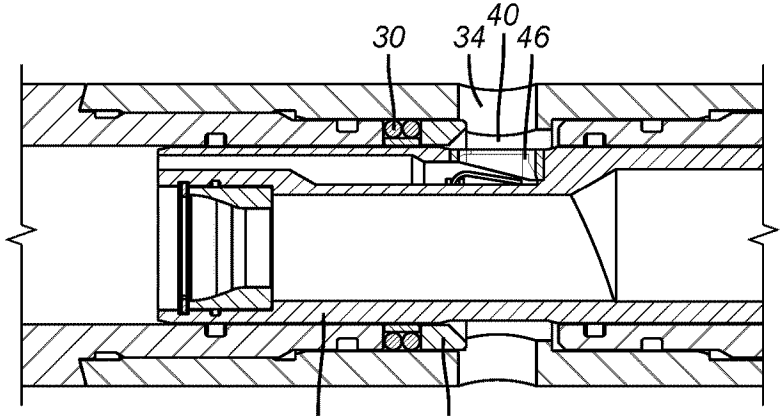
FIG. 4 is an enlarged view of FIG. 3.

FIG. 2 shows a layout of the schematic design of FIG. 1. The housing 10 is multicomponent between ends 12 and 14 Piston 16 has an extension tube 36 with a flange 38 against which spring 22 applies an uphole force. Multiple ports 34 communicate with an annular plenum 40 that is closed off by piston 16 and seals 30 and 32. Seal 32 is on piston 16 while seal 30 is fixed in the housing 10 near the upper end 14. Passage 19 has a removable orifice 42 held with a removable retainer 44. Retainer 44 can be threaded or otherwise attached to hold orifice 42 piston 16. The use of an orifice or any restriction in passage 19 is optional. Hardened nozzles 46 communicate with plenum 40 and the combined flow into plenum 40 exits housing 10 through ports 34. Hardened wear ring 48 protects seal 30 and housing 10 from erosive action of high velocity flow, particularly when piston 16 has not shifted fully in to the wide open bypass position of FIG. 3.

Figure 5:
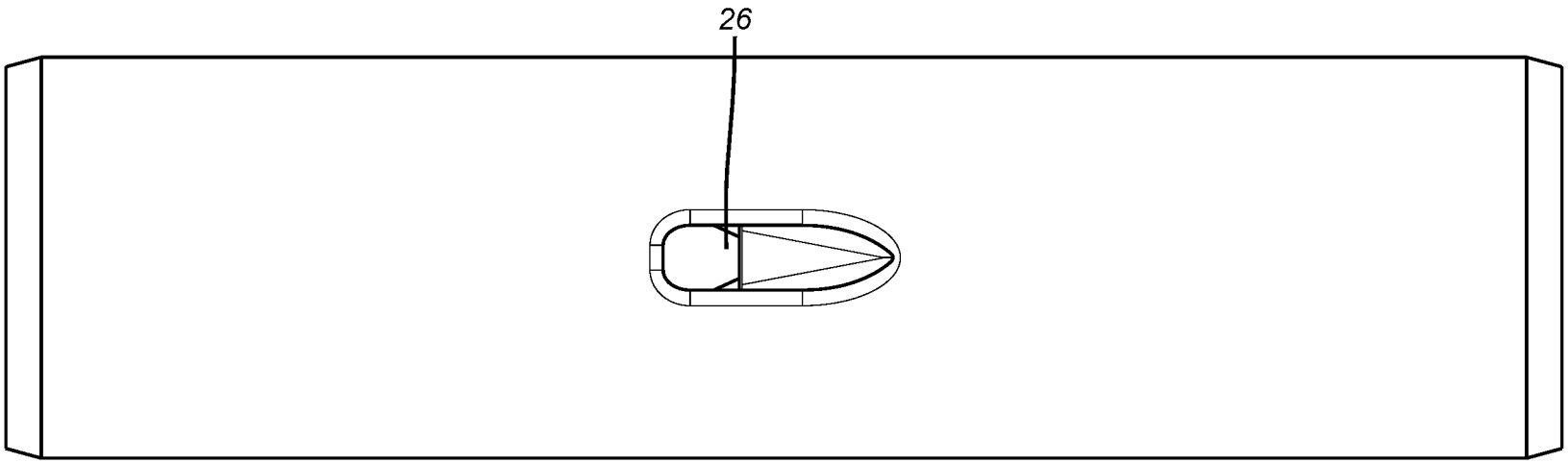
FIG. 5 is an external view of the piston showing an integrated exit port.
Figure 6:
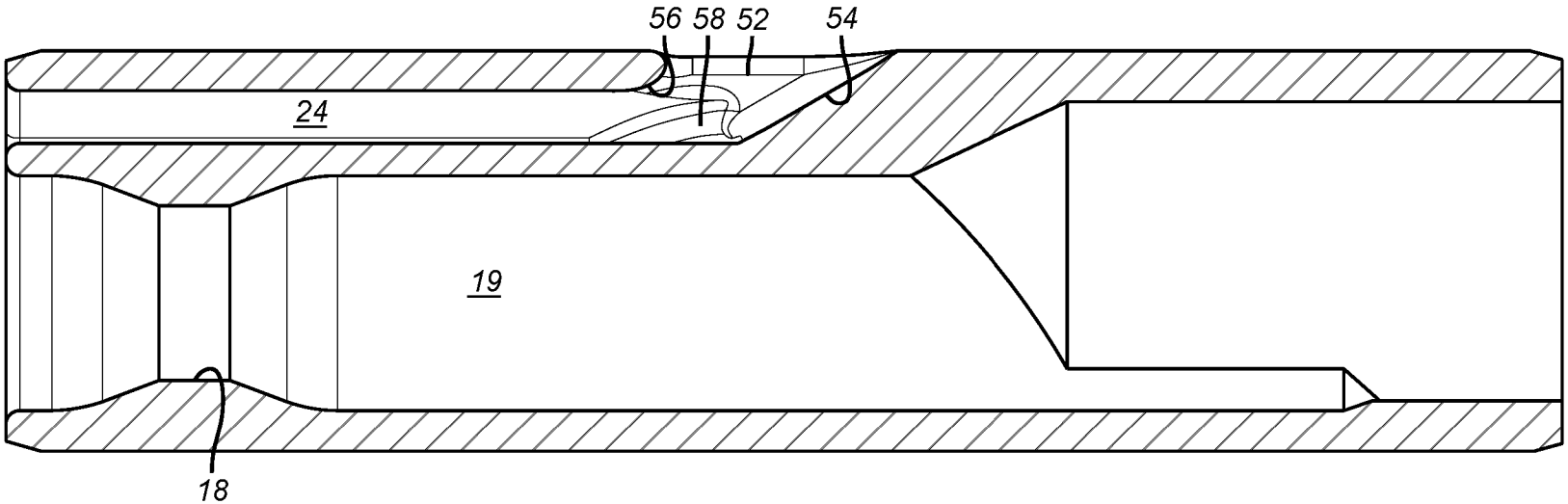
FIG. 6 is a section view through the piston of FIG. 5.
Figure 7:
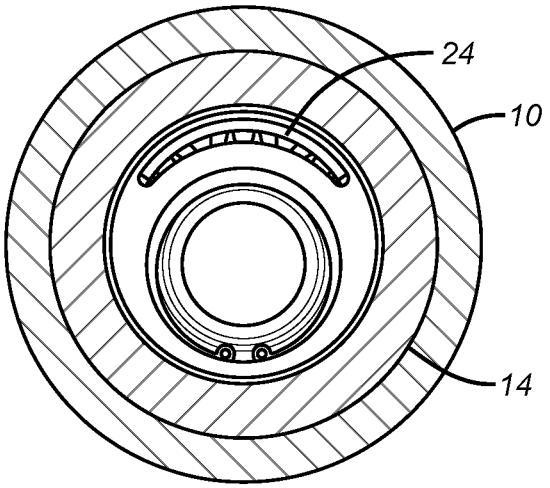
FIG. 7 is a section view of FIG. 4 showing the inlet to the piston.
Figure 8:
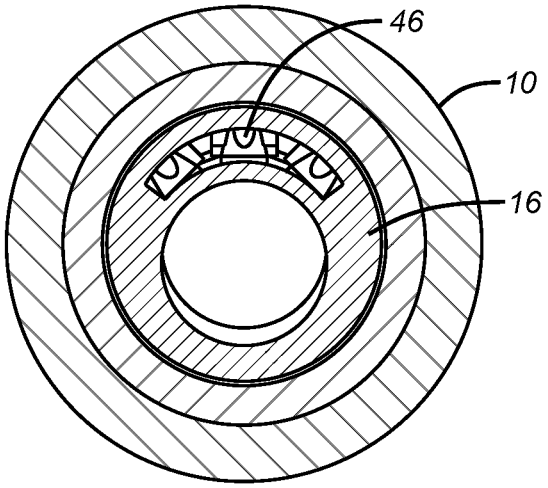
FIG. 8 is another section view below FIG. 7 at the annular diffuser chamber level.
Figure 9:
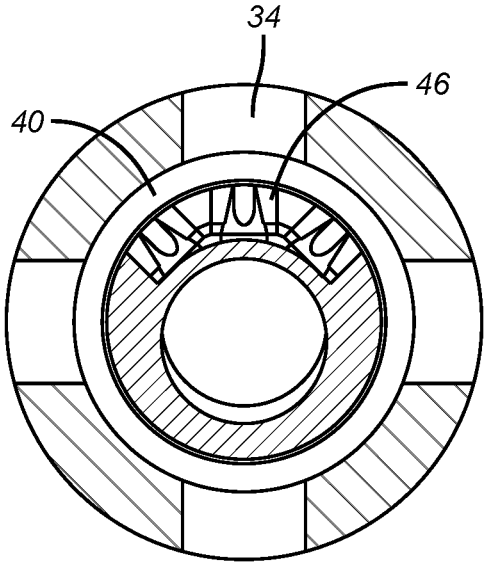
FIG. 9 is another section below FIG. 8 at the housing port level.
Figure 12:
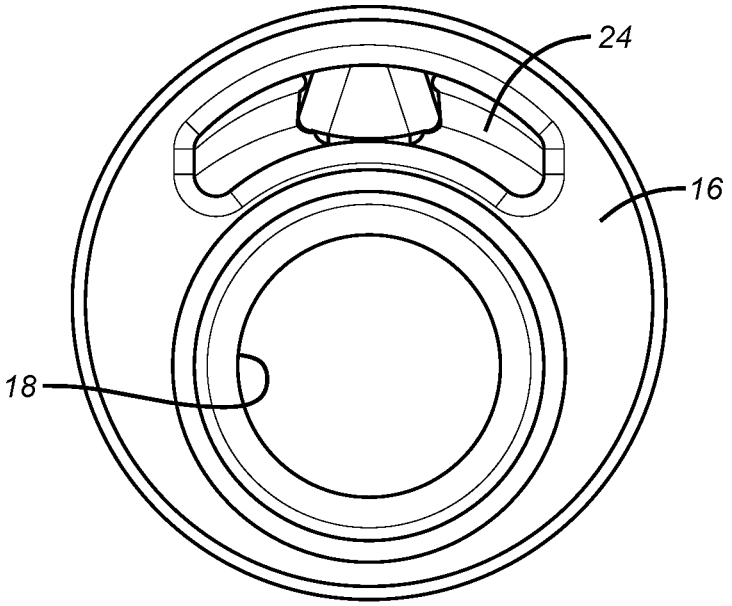
FIG. 12 is an end view through the piston of FIG. 6.

FIGS. 5 and 6 show recirculation passage 24 terminating in an outlet 52 that has formed downhole taper 54 and a rounded uphole end 56. An internal deflector ramp 58 can be provided. Those skilled in the art will appreciate that the various configurations described with the exception of FIGS. 14 and 15 can only economically be fabricated with the process of additive manufacturing. While FIGS. 5 and 6 show a single piston outlet port 26 there can be multiple ports circumferentially offset such that the passage 24 has a crescent shaped entrance as shown in FIGS. 7 and 12. If nozzles 46 are used in the FIGS. 5 and 6 design they can align with respective openings 26 of the piston 16 for insertion and securing such as by brazing or with adhesive or other known ways of fixation. FIG. 8 shows a section view through piston 16 at the location of the nozzles 46. FIG. 9 shows another section view a bit lower down illustrating the plenum 40 leading to multiple outlets 34 where some nozzles are out of alignment with ports 34 but others can be in radial alignment with an opening 34. Four openings 34 are shown and three nozzles 46 but different quantities of each can be used. The additive machining process allows this and the use of the plenum 40 volume allows all the outlets of the nozzles 46 to reach an outlet port 34 even if the flow direction is reoriented one or more times to find a path to exit for recirculation flow while avoiding passing through the mud motor.

Figure 10:
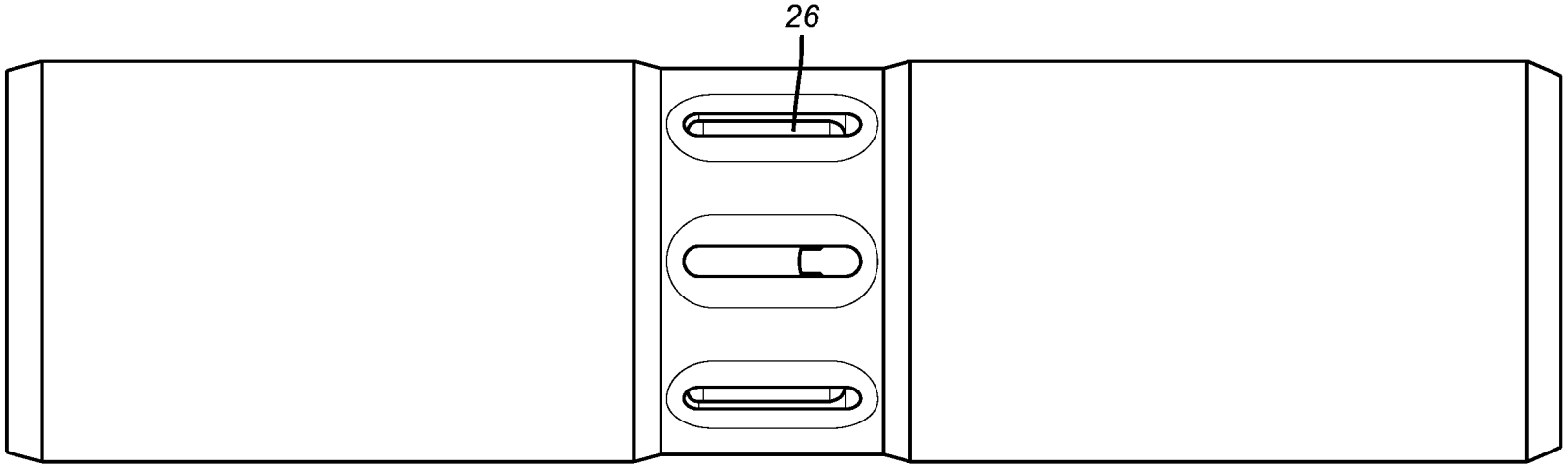
FIG. 10 is an external view of the piston of FIGS. 2 and 3.
Figure 11:
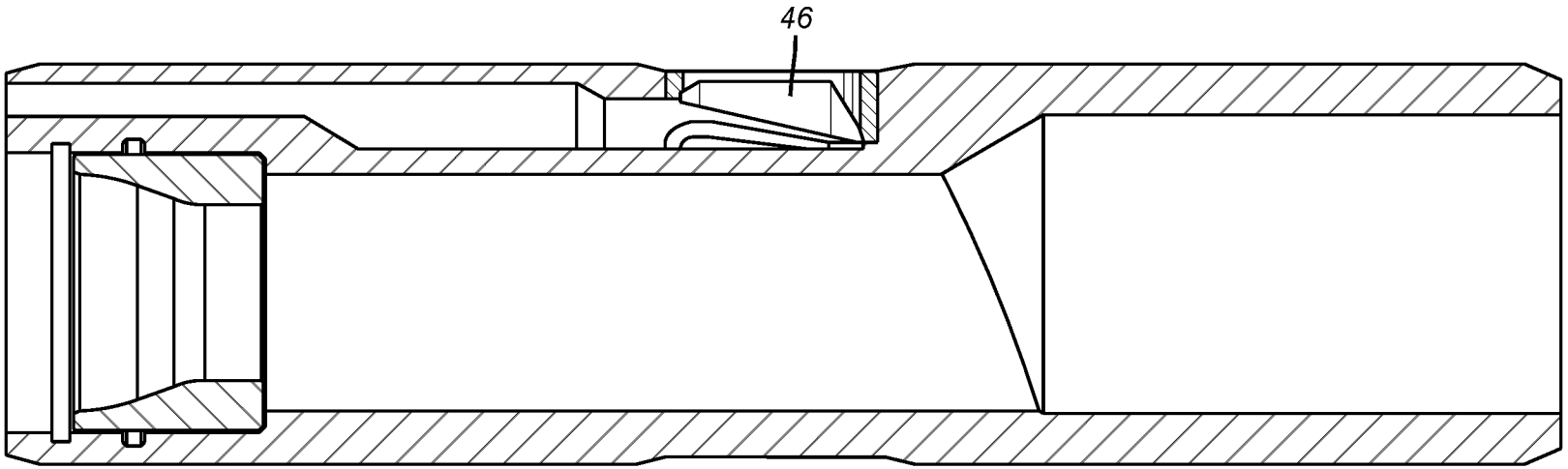
FIG. 11 is a section view through the piston of FIG. 10.
Figure 13:
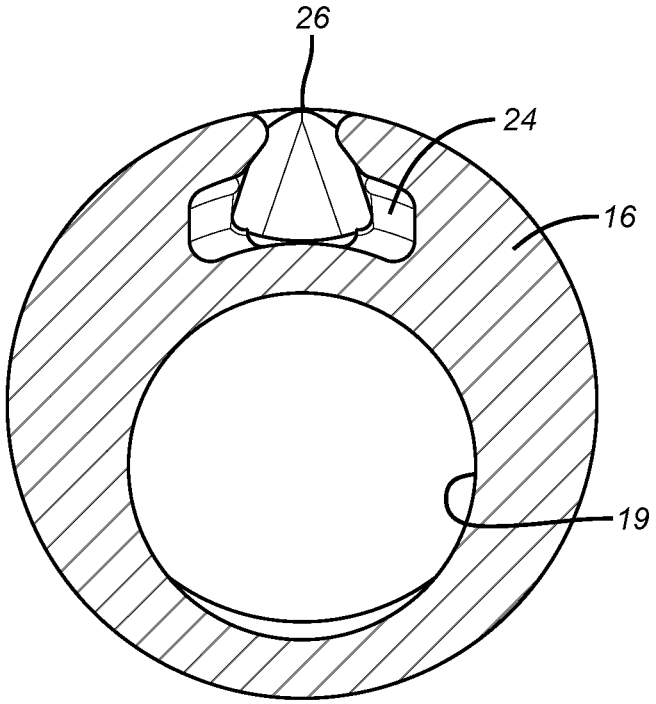
FIG. 13 is a section view through the piston of FIG. 6 at the top of the outlet from the piston.

FIG. 10 is an external view of piston 16 in FIG. 2. FIG. 11 is a cross section view of FIG. 10. FIGS. 8 and 9 show section views of the piston 16 corresponding to the embodiment of FIGS. 10 and 11. FIGS. 12 and 13 correspond to the variation shown in FIGS. 5 and 6.

Figure 14:
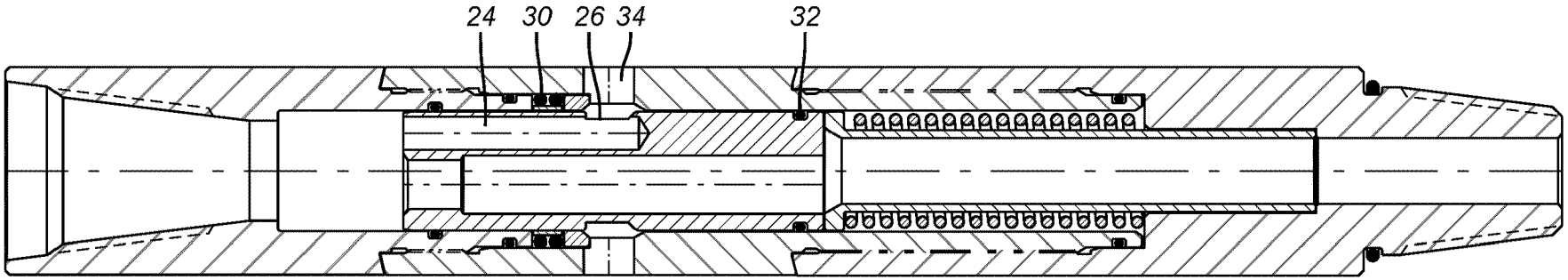
FIG. 14 is a section view of an assembly where the piston is not made with additive manufacturing in the bypass open position.
Figure 15:
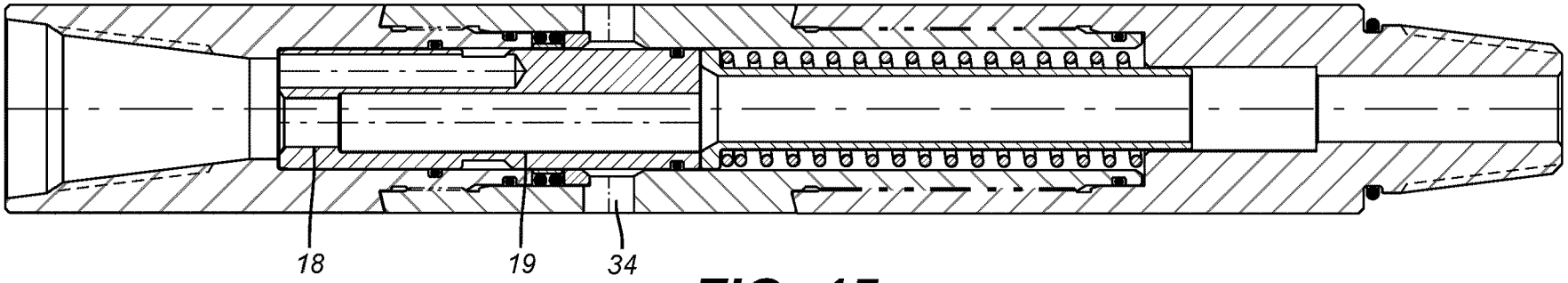
FIG. 15 is the view of FIG. 14 with the bypass closed position.

FIGS. 14 and 15 show the limitations of fabrication of piston 16 using intersecting bores to construct passage 24 to opening 26. Here depending on the size of the piston 16 only a single drilled bore 24 may be possible that is intersected at right angles with another bore to create the exit port 26. On the other hand when using additive manufacturing internal passageways can be created that cannot be made with other fabrication techniques currently known or even using known casting or molding techniques. A crescent shaped bypass passage 24 can be created with multiple outlets into which a nozzle can be secured. The surrounding housing 10 can define a plenum 40 that links outlets of multiple nozzles 46 for ultimate flow exit through openings 34 in housing 10 for recirculation bypassing the mud motor or other tool that is in the bottom hole assembly that is not shown.

The various described embodiments split flow between straight through and recirculation so that as the flow increases there are two distinct paths and recirculated flow avoids the straight through flow restricting path. While all flow goes through the piston, the flow is split within the piston in discrete straight through and recirculating paths. The piston with these discrete paths is additively manufactured to allow multiple exit nozzles for the recirculating path that can discharge into aligned outlet ports in the surrounding housing or into a plenum between the piston and the outer housing where flow can exit out radially or can be redirected at least once to a nearby housing exit port. The discrete recirculation path can be crescent shaped to maximize the number of outlets particularly in the smaller sizes.

The above description is illustrative of the preferred embodiment and many modifications may be made by those skilled in the art without departing from the invention whose scope is to be determined from the literal and equivalent scope of the claims below:

We claim:

1. A fluid pressure actuated diverter valve apparatus for controlling fluid flow to a mud motor for a milling tool supported on a tubular string, comprising:

a housing forming a part of the tubular string and further comprising an inlet, a straight through outlet and at least one lateral wall port;

a piston reciprocally mounted within said housing;

the piston including a top end, at least one internal passage disposed through the piston downwardly from the top end through which fluid is permitted to flow through the piston to the mud motor without obstruction during a milling operation;

a lateral flow passage which extends between the top end and a lateral outlet within the piston;

wherein the piston is reciprocated from an upper position and a lower position within the housing by increasing flow through the piston to maintain a predetermined flow to the mud motor by circulating excess flow into said housing through said lateral flow passage; and wherein at least a portion of the lateral flow passage is maintained at a position within the housing above the lateral wall port when the piston is in the lower position.

2. The apparatus of claim 1, wherein:

the lateral flow passage includes a plurality of split flow paths deviating from the orifice.

3. The apparatus of claim 2, wherein:

at least one of the split flow paths remains in fluid communication through the piston to permit flow from a flow path above the piston to a flow path below the piston.

4. The apparatus of claim 3, wherein:

at least one of the split flow paths is obstructed when the piston is in its upper position from permitting fluid communication through the piston and through the lateral wall port in the housing.

5. The apparatus of claim 4, wherein:

at least one of the split flow paths is in fluid communication through the piston when the piston is in its lower position to permit flow from the flow path above the piston through the lateral wall port to an annulus outside of the housing.

6. The apparatus of claim 1, wherein:

said lateral flow passage further comprises a crescent shaped inlet at said top end of said piston.

7. The apparatus of claim 1, wherein:

said housing defines an interior plenum about said at least one lateral wall port;

said lateral flow passage comprising multiple outlets selectively axially aligned with said plenum.

8. The apparatus of claim 7, wherein:

said at least one lateral wall port comprises multiple circumferentially spaced wall ports communicating with said interior plenum;

at least one of said multiple outlets is circumferentially misaligned with at least one said wall port.

9. The apparatus of claim 7, wherein:

said lateral flow passage extending substantially parallel to said straight through passage until turning radially outwardly to orient said multiple outlets radially toward said plenum.

10. The apparatus of claim 1, wherein:

said multiple outlets further comprise hardened nozzles with outlets oriented radially into said plenum.

11. The apparatus of claim 1, wherein:

said at least one lateral wall port comprises a plurality of spaced wall ports;

said lateral flow passage comprising multiple outlets each selectively aligned with a respective wall port.

12. The apparatus of claim 1, wherein:

said lateral flow passage comprising multiple outlets each angularly oriented toward a downhole end of said piston.

13. The apparatus of claim 1, wherein:

said housing further comprising a hardened ring to protect at least one seal around said piston from erosion of fluid flowing past one or more outlets from said lateral flow passage.

14. The apparatus of claim 1, wherein:

said internal passage and said lateral flow passage extend axially from said top end of said piston with said lateral flow passage comprising a crescent shape cross section with multiple outlets radially extending outlets adjacent said outer periphery of said piston.

15. The apparatus of claim 14, wherein:

said piston is fabricated with an additive manufacturing process.

16. The apparatus of claim 1, wherein:

said piston comprises a clearance fit to said housing for damping high frequency movement of said piston resulting from fluid flow.

17. The apparatus of claim 16, wherein:

said internal passage is unrestricted.

18. The apparatus of claim 1, wherein:

said flow generated force is created in said internal passage.

19. The apparatus of claim 1, wherein:

the shape of at least one of said passages is round, oval or crescent.

20. The apparatus of claim 1 further comprising:

an orifice defined within the top end of the piston from which the internal passage and the lateral flow passage both extend.

21. The apparatus of claim 1 further comprising:

a separate axial end opening for the lateral flow passage at the top end of the piston.

22. A flow control method for a borehole tool, comprising:

providing a housing further comprising an inlet, a straight through outlet and at least one lateral wall port, the housing further having end connections for attaching to a tubular string to position a borehole tool in a borehole;

additively manufacturing a piston in said housing selectively covering said wall port, said piston comprising an internal passage extending downwardly from an orifice proximate a top end of the piston in flow communication with said straight through outlet and a lateral flow passage beginning adjacent said top end to a circulation outlet and extending to an outer periphery of said piston, said circulation outlet movable into aligned or misaligned positions with respect to said at least one lateral wall port responsive to flow generated force in said straight through passage opposing a bias force on said piston;

maintaining a predetermined flow to the borehole tool by circulating excess flow into said housing through said lateral flow passage, at least a portion of the lateral flow passage remaining above the lateral wall port as said excess flow is circulated.

23. The method of claim 22, comprising:

maintaining said lateral flow passage circulation outlet no lower than said at least one wall port.

24. The method of claim 22, comprising:

shaping said lateral flow passage in a crescent shape in an axial orientation with multiple openings as said circulation outlet.

25. The method of claim 24, comprising:

making said at least one wall port multiple wall ports;

directing said multiple openings into a plenum defined by said housing and placing nozzles in said openings to direct flow into said plenum and through said multiple wall ports.

* * * * *